US005185183A

United States Patent [19]

Gonda et al.

[11] Patent Number: 5,185,183

[45] Date of Patent: Feb. 9, 1993

[54] APPARATUS AND METHOD FOR BLASTING AND METAL SPRAYING A CYLINDRICAL SURFACE

[75] Inventors: John K. Gonda, Birmingham, Ala.; Benny C. Bachman, Spokane, Wash.; Mike Boyer, Hayden Lake, Id.; Jerry L. Bly, Deer Park; Donald Gilliland, Spokane, both of Wash.

[73] Assignee: Westinghouse Electric Corp., Pittsburgh, Pa.

[21] Appl. No.: 819,416

[22] Filed: Jan. 10, 1992

[51] Int. Cl.[5] ..... B05D 7/22

[52] U.S. Cl. ..... 427/236; 427/239; 427/292; 427/405; 427/421; 427/427; 118/72; 118/315; 118/317; 118/323; 51/411

[58] Field of Search ..... 427/236, 239, 290, 292, 427/421, 427, 405; 118/72, 315, 317, 323; 51/410, 411, 429

[56] References Cited

U.S. PATENT DOCUMENTS 4,762,013 8/1988 Peter et al. ..... 118/315

FOREIGN PATENT DOCUMENTS 52-36394 3/1977 Japan ..... 51/411

906681 2/1982 U.S.S.R. ..... 51/411

*Primary Examiner*—Shrive Beck

*Assistant Examiner*—Terry J. Owens

*Attorney, Agent, or Firm*—G. H. Telfer

[57] ABSTRACT

A method and apparatus for automatically grit blasting and metal spraying a wall of a cylindrical vessel utilizing a pair of rails with arms slidably disposed thereon, which rotate 180° in unison about the axis of the vessel and then reverse and are moved incrementally along the rails upon completion of each 180° of rotation until the wall of the vessel is grit blasted by a grit blasting nozzle on each arm and then sprayed with multiple thin layers of molten metal by a molten metal sprayer on each arm. The grit blasting nozzle and molten metal sprayer may be interchangeably mounted on the arms or may be both installed and operated separately.

15 Claims, 3 Drawing Sheets

APPARATUS AND METHOD FOR BLASTING AND METAL SPRAYING A CYLINDRICAL SURFACE

BACKGROUND OF THE INVENTION

The invention relates to an apparatus and method for grit blasting and metal arc spraying and more particularly to such apparatus and method for automatically coating the inside of a continuous wood pulp digester with a corrosion and erosion protective metal layer of uniform thickness.

Manually grit blasting and then manually coating the inside of a vessel is time consuming and does not result in a completed overlay of uniform thickness.

SUMMARY OF THE INVENTION

Among the objects of the invention may be noted the provision of an apparatus and method for grit blasting a cylindrical surface to provide a properly cleaned and textured surface to accept and hold a sprayed metal overlay and to apply the sprayed overlay so that when completed the overlay has a substantially uniform thickness.

In general, a method of automatically blasting and metal spraying a cylindrical vessel, when utilized in accordance with this invention, comprises the steps of:

providing a pair of guide rails disposed generally parallel to the cylindrical surface and 180° apart in a relation to the center of the cylindrical surface;

providing a pair of radially oriented arms so disposed that each arm extends generally normal to a respective guide rail with a distal end of each arm oriented toward the cylindrical surface;

slidably attaching each of the arms to a respective guide rail;

installing a grit blasting nozzle on a distal end of each arm;

orienting the nozzles to grit blast the cylindrical surface;

rotating the rails in unison about the axis of the vessel about 180° to grit blast a circumferential band around the cylindrical surface and then reversing the 10 direction of rotation;

moving the arms incrementally along the rails upon completion of each 180° of rotation to grit blast the desired portion of the cylindrical surface with the desired number of passes;

installing on the distal end of each arm means for spraying molten metal;

orienting the metal spraying means to spray the cylindrical surface with a thin coat of molten metal;

rotating the rails in unison about the axis of the vessel about 180° to deposit a circumferential band of a thin layer of metal on the cylinder and then reversing the direction of rotation;

moving the arms incrementally along the rail upon completion of each 180° of rotation to deposit a circumferential band of a thin layer of metal; and continuing to rotate the rails and moving the arms until numerous thin layers of metal have been sprayed on the cylindrical surface, whereby the cylindrical surface is coated with a uniformly thick layer of metal.

Apparatus for automatically grit blasting and metal spraying a cylindrical surface on a vessel, when made in accordance with this invention comprises a pair of guide rails disposed generally parallel to the cylindrical surface;

a pair of radially oriented arms, each arm extending generally normal to a respective guide rail and oriented toward the cylindrical surface, each of the arms being slidably connected to the respective guide rail;

a grit blasting nozzle disposable on a distal end of each arm and oriented to blast the cylindrical surface;

means for spraying molten metal disposable on the distal end of each of the arms and oriented to spray molten metal on the cylindrical surface;

means for sequentially rotating the rails in unison about the axis of the vessel about 180° and then reversing the direction of rotation;

means for moving the arms incrementally along the rail upon completion of 180° of rotation of the rails, whereby the cylindrical surface can be grit blasted and a thin layer of molten metal can be sprayed over the grit blasted cylindrical surface.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
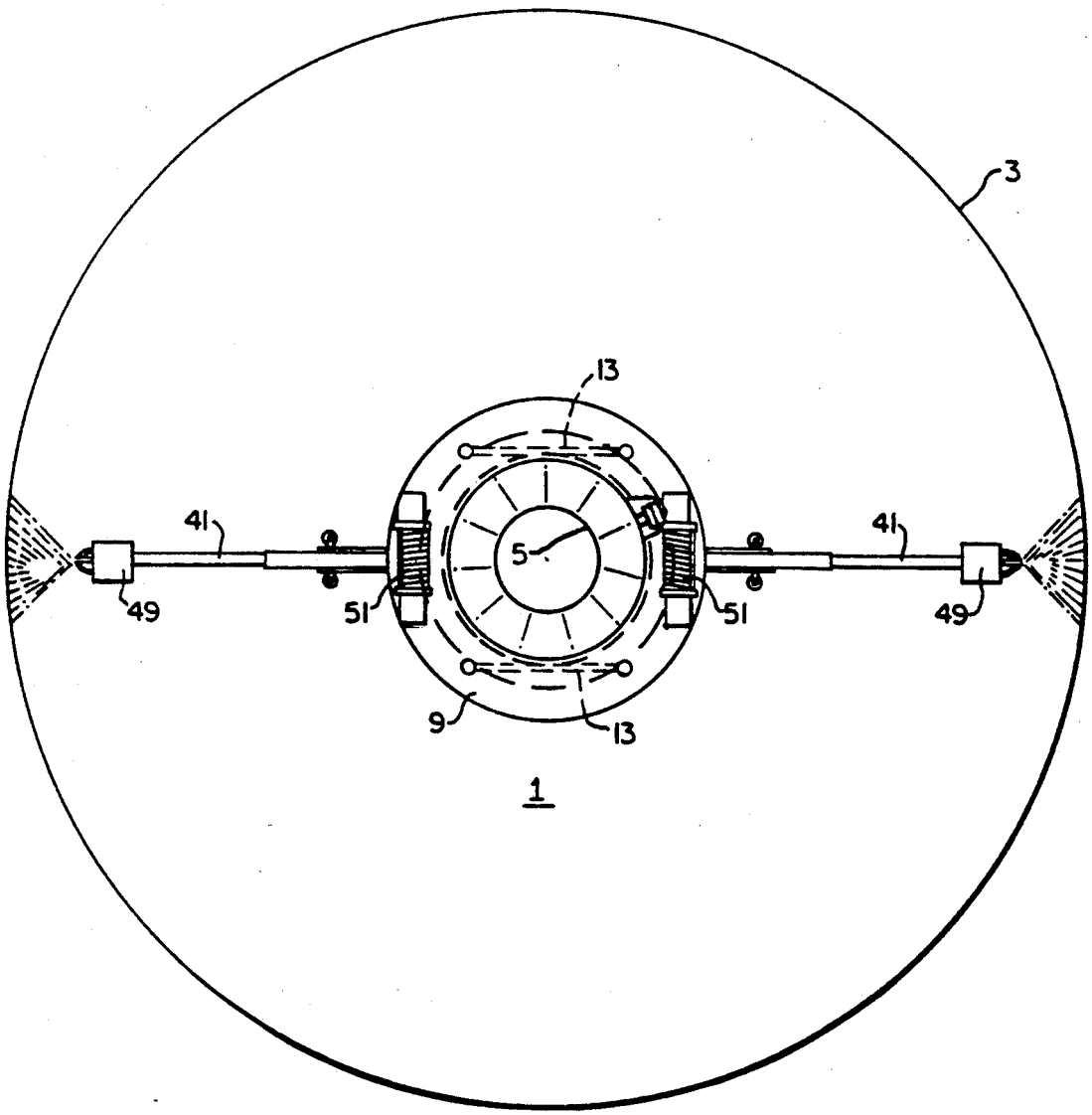
FIG. 1 is a plan view of apparatus for blasting and metal spraying showing metal spraying devices disposed in a vessel.

Referring now to the drawings in detail there is shown apparatus 1 for grit blasting and metal spraying the internal cylindrical wall surface of a vessel 3 having a centrally disposed stand pipe 5.

Figure 2:
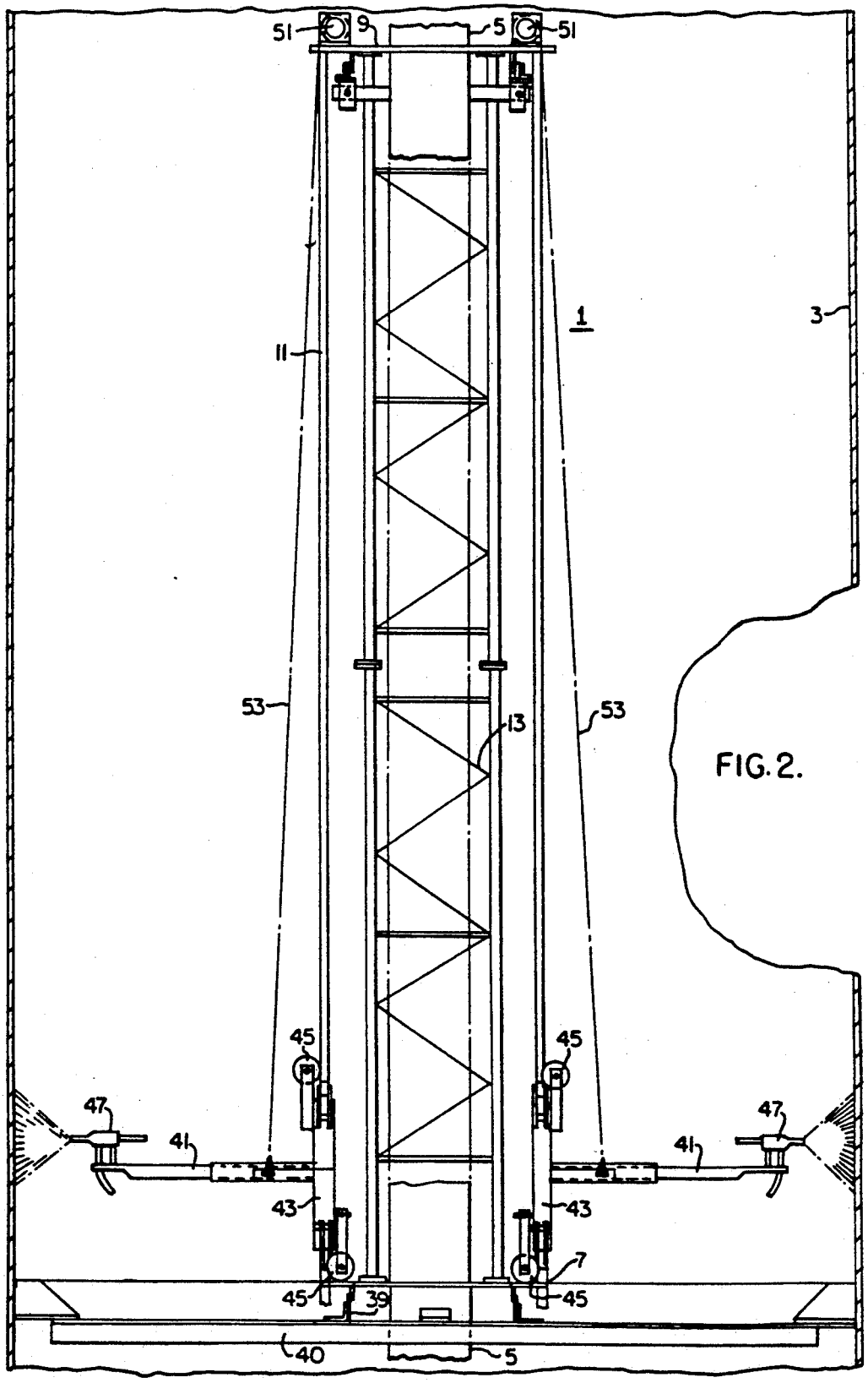
FIG. 2 is an elevational view of the apparatus showing grit blasting nozzles disposed in the vessel.
Figure 3:
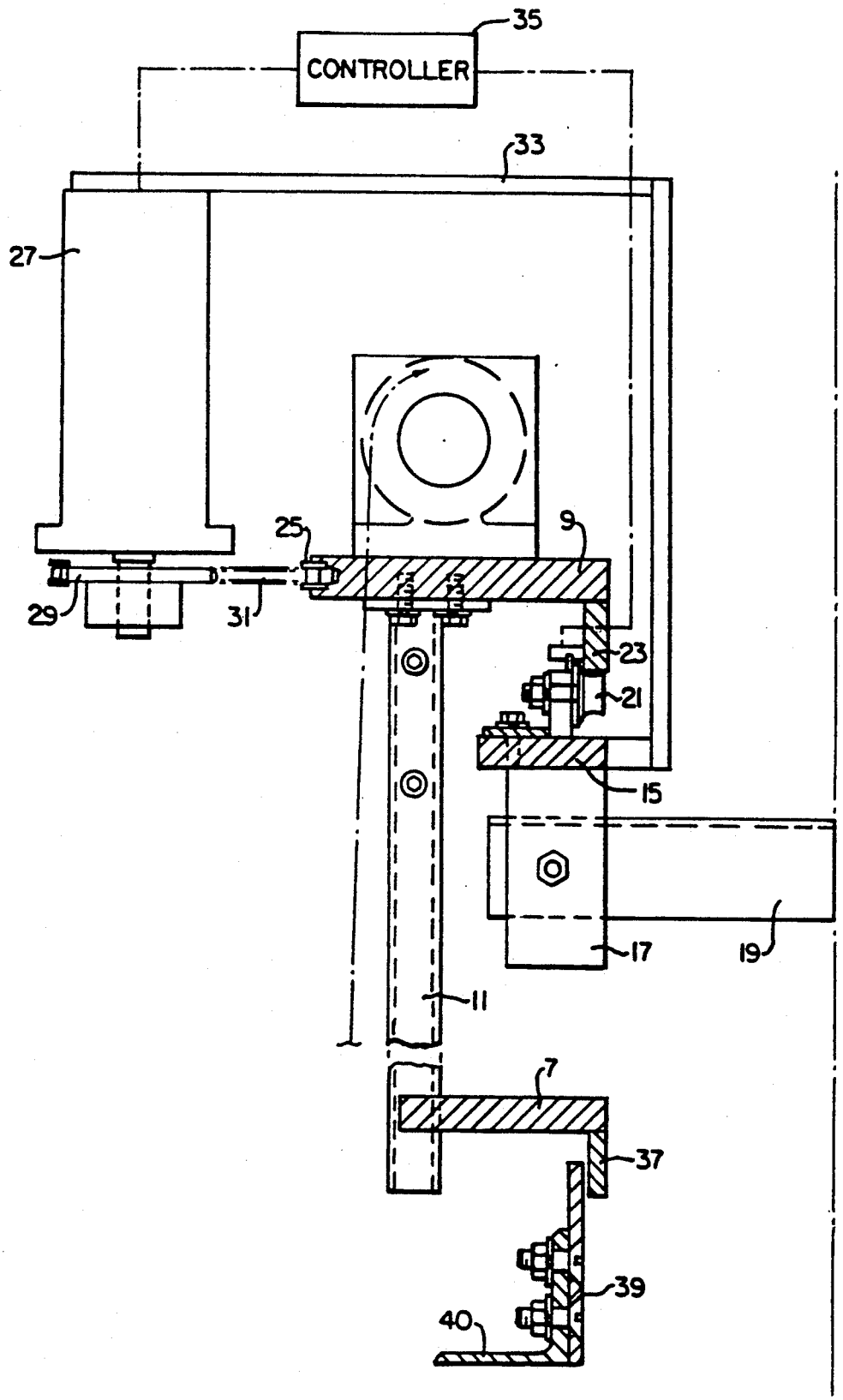
FIG. 3 is an enlarged partial sectional view of the apparatus.

As shown best in FIGS. 2 and 3, the apparatus comprises a bottom ring 7 and a top ring 9, a pair of parallel guide rails 11 disposed to extend between the rings 7 and 9 and parallel to the axis of the vessel on opposite sides thereof. A pair of trusses 13 form a column like structure that is disposed to extend between the rings 7 and 9 on opposite sides of the axis of the vessel and generally 90° from the rails 11 and cooperate therewith to form a light weight relative stiff structure. A support plate 15 is connected by a connecting bar 17 to a collar 19 which clamps to the pipe 5, fixing the support plate 15 with respect to the vessel 3. A plurality of flanged rollers 21 are bracket mounted on the support plate 15 and cooperate with a circular bar or track 23 attached to the top ring 9 to allow the rings 7 and 9 and the rails 11 to rotate about the axis of the vessel 3. The top ring 9 has a sprocket 25 attached thereto and cooperates with a hydraulic motor 27, sprocket 29 and chain 31 to rotate the rings 7 and 9 and rails 11 with respect to the axis of the vessel 3. A motor mounting bracket 33 attaches the motor 27 to the support plate 15. A controller 35 drives the motor 27 so that the rings 7 and 9 and rails 11 are rotated about 180°, after which the controller 35 reverses the motor 27 rotating the rings 7 and 9 and rails 11 about 180° in the opposite direction providing sequential reversing after each half revolution. The controller 35 which may comprise limit switches on the motor 27 or on the apparatus 1. These limit switches are reset to change the radial position where the reversing takes place.

The bottom ring 7 also has a circular bar 37 depending therefrom. A bottom collar 39 is disposed so its distal end overlaps and is outboard of the distal end of the circular bar 37. The bottom collar 39 is attached to an angle iron brace 40 bridging the vessel 3 to prevent the lower end of the apparatus from getting excessively off center with respect to the axis of the vessel 3.

Referring now to FIGS. 1 and 2, the apparatus comprises a pair of radially oriented arms 41 slidably disposed on the rails 11 by a tubular guide 43 having a plurality of wheels 45 disposed thereon to roll on the guide rails 11 to reduce frictional contact and prevent wobbling of the tubular guide 43 on the guide rails 11. The arms 41 ar oriented toward the cylindrical wall or surface of the vessel 3 and are radially adjustable so they can be moved radially toward and away from the wall of the vessel 3. A grit blasting nozzle 47 (FIG. 2) is disposed on the distal end of each arm or an arc spray gun 49 (FIG. 1) or other means for spraying molten metal on the wall of the vessel 3. While in the preferred embodiment either the blasting nozzle or arc spray gun is mounted on the arms, depending on the process being utilized, they could both be installed with only one or the other operating at one time.

A pair of winches 51 are disposed on the top ring 9 above the guide rails 11 and have a cable 53 connected to a respective arm 41. The winches 51 are driven by stepping motors to raise and lower the arms 41 an incremental amount each time the arm 41 has completed a rotation of about 180°.

The method of operating the apparatus to automatically grit blast and metal spray a cylindrical vessel comprises the steps of:

Providing a pair of guide rails 11 disposed generally parallel to the cylindrical wall of the vessel 3 and 180° apart in relation to the center of the cylindrical surface;

Providing a pair of radially oriented arms 41 slidably disposed on the guide rails 11 so the each arm extends toward the cylindrical wall of the vessel 3;

Installing a grit blasting nozzle 47 on the distal end of each arm 41 and orienting the nozzle 47 toward the wall to grit blast a circumferential band around the wall of the vessel 3;

Rotating the rails 11 and arms 41 in unison about 180° around the axis of the vessel 3 to grit blast a circumferential band around the wall of the vessel 3 and then reversing the direction of rotation;

Moving the arms 41 incrementally along the rails 11 upon completion of each 180° rotation to grit blast the wall of the vessel 3 or to make a grit blast pass over the wall of the vessel 3:

Making a plurality of grit blast passes over the wall of the vessel 3 and changing the grit to new or unused grit prior to the last or last few passes to provide a surface upon which the metal spray will form a good bond;

Installing a metal spraying gun 49 on the distal end of each arm 41 and orienting the metal spraying gun 49 toward the wall of the vessel 3 to spray a thin coat of molten metal on the vessel wall:

Rotating the rails 11 and arms 41 in unison about 180° to deposit a thin layer of metal forming a circumferential band of metal on the wall of the vessel 3 and reversing the direction of rotation after each 180° of rotation;

Moving the arms incrementally along the rails 11 upon completion of each 180° of rotation;

Changing the circumferential location where the rails 11 begin and end their 180° of rotation when the wall surface of the vessel 3 has been sprayed with a thin layer of metal or upon the completion of each pass of the metal spray over the wall surface of the vessel 3;

Making a plurality of metal spray passes over the wall of the vessel 3 generally building up 30 to 40 thin layers of sprayed metal, which are very uniform. Since the location of the commencement of the 180° varies in each pass, the build up inherently occurring at the location or the reversal is systematically moved around the wall of the vessel 3 to produce a very uniform overlay on the wall of the vessel 3.

While the preferred embodiments described herein set forth the best mode to practice this invention presently contemplated by the inventors numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A method of automatically blasting and metal spraying a cylindrical surface of a vessel comprising the steps of:

providing a pair of parallel guide rails disposed generally parallel to said cylindrical surface;

providing a pair of radially oriented arms so disposed that each arm extends generally normal to one of said guide rails with a distal end of each arm oriented toward said cylindrical surface;

slidably attaching each of said arms to its respective guide rail;

installing a grit blasting nozzle on a distal end of each arm;

orienting said nozzle to grit blast the cylindrical surface;

rotating said rails in unison about the axis of said vessel about 180° to grit blast a circumferential band around said cylindrical surface and then reversing the direction of rotation;

moving said arms incrementally along said rails upon completion of each 180° of rotation to grit blast a desired portion of the cylindrical surface with a desired number of passes along said desired portion;

installing on the distal end of each arm means for spraying molten metal;

orienting the metal spraying means to spray said cylindrical surface with a thin coat of molten metal;

rotating said rails in unison about the axis of said vessel about 180° to deposit a circumferential band of a thin layer of metal on said cylinder and then reversing the direction of rotation;

moving said arms incrementally along said rail upon completion of each 180° of rotation to deposit a circumferential band of a thin layer of metal; and continuing to rotate said rails and moving said arms until numerous thin layers of metal have been sprayed on said cylindrical surface, whereby the cylindrical surface is coated with a uniformly thick layer of metal.

2. The method of claim 1, comprising the step of changing the circumferential location where the rails begin to rotate after completion of each pass of spraying molten metal on the cylindrical surface.

3. The method of claim 1, comprising the step of changing the grit to new grit prior to grit blasting the last pass.

4. The method of claim 1, comprising the step of changing the grit to new grit prior to grit blasting the last few passes.

5. The method of claim 2, comprising the step of spraying the cylindrical surface with 30 to 40 thin passes of molten metal to provide an overlay having a uniform thickness.

6. The method of claim 1, wherein the cylindrical surface is on the inner surface of the vessel.

7. Apparatus for automatically grit blasting or metal spraying a cylindrical surface on a vessel comprising:

a pair of guide rails disposed generally parallel to said cylindrical surface;

a pair of radially oriented arms, each arm extending generally normal to a respective guide rail and oriented toward said cylindrical surface, each of said arms being slidably connected to the respective guide rail;

means disposed on a distal end of each arm for directing material, from the group consisting of grit and molten metal, against the cylindrical surface;

means for sequentially rotating said rails in unison about the axis of said vessel about 180° and then reversing the direction of rotation;

means for moving said arms incrementally along said rails upon completion of each 180° of rotation of said rails, whereby the cylindrical surface can be grit blasted or a thin layer of molten metal can be sprayed over a grit blasted cylindrical surface by operation of the means for directing material.

8. The apparatus of claim 7, further comprising means for adjusting the location where the rails begin and end their 180° rotation when completing a pass of spraying a thin layer of metal on the cylindrical surface.

9. The apparatus of claim 7, further comprising a bottom ring and a top ring, the rails extending between the rings and being attached thereto; a pair of trusses disposed diametrically opposite each other to form a column like support between the bottom ring and the top ring; the top ring being rotatable with respect to a support plate and the support plate being generally fixed with respect to the vessel.

10. The apparatus of claim 9, wherein the means for rotating the rails comprises a motor and drive mechanism connected to one of said plates and fixed with respect to the vessel, and further comprising means for reversing the motor each time the connected plate has rotated about 180°.

11. The apparatus of claim 10, wherein the means for incrementally moving the arms on the rails comprises a pair of winches disposed on the top ring and attached to the arms by cables and stepping drives to rotate the winches an incremental amount to raise and lower the arms.

12. The apparatus of claim 7, wherein the arms are radially adjustable to properly aposition the means for directing material.

13. The apparatus of claim 7, wherein the means for directing material comprises a grit blasting nozzle oriented to blast the cylindrical surface.

14. The apparatus of claim 7, wherein the means for directing material comprises a means for spraying molten metal oriented to spray molten metal on said cylindrical surface.

15. The apparatus of claim 7, wherein the means for directing material comprises at each distal end of the each arm both a grit blasting nozzle and a means for spraying molten metal.

* * * * *